United States Patent [19]

Panzer et al.

[11] Patent Number: 5,030,340

[45] Date of Patent: Jul. 9, 1991

[54] METHOD FOR THE DEPRESSING OF HYDROUS SILICATES AND IRON SULFIDES WITH DIHYDROXYALKYL POLYSACCHARIDES

[75] Inventors: Hans P. Panzer, Stamford, Conn.; Michael Peart, Cardiff, Great Britain

[73] Assignee: American Cyanamid Company, Stamford, Conn.

[21] Appl. No.: 535,219

[22] Filed: Jun. 8, 1990

[51] Int. Cl.[5] ..... B03D 1/016; B03D 1/02

[52] U.S. Cl. ..... 209/167; 252/61

[58] Field of Search ..... 209/166, 167; 252/61

[56] References Cited

U.S. PATENT DOCUMENTS

| | | | |
|---|---|---|---|
| 1,632,419 | 6/1927 | Simpson | 209/166 |
| 1,741,028 | 12/1929 | Koenig | 209/167 |
| 1,771,549 | 7/1930 | Phelan | 209/167 |
| 2,135,128 | 3/1937 | Thomas | 106/197.2 |
| 2,824,643 | 2/1958 | Shaw | 209/166 |
| 2,919,802 | 1/1960 | Drak | 209/167 |
| 3,710,939 | 1/1973 | Hostynek | 209/166 |
| 4,001,210 | 1/1977 | Engeskirchen | 106/170 |
| 4,339,331 | 7/1982 | Lim | 209/167 |
| 4,877,517 | 10/1989 | Bulatovic | 209/167 |

FOREIGN PATENT DOCUMENTS

| | | | |
|---|---|---|---|
| 1456392 | 11/1976 | United Kingdom | 209/167 |

OTHER PUBLICATIONS

"The Carbohydrates" Edited by Ward Pigman Published 1957 by Academic Press, pp. 669–670.

"Polymeric Depressants", by K. F. Lin et al., Published in the Periodical Reagents, Mineral Technology, pp. 471–483.

The Poseidon Story, Engineering and Mining Journal, Feb. 1975, pp. 53–62.

*Primary Examiner*—Stanley Silverman

*Assistant Examiner*—Thomas M. Lithgow

*Attorney, Agent, or Firm*—Frank M. Van Riet

[57] ABSTRACT

A process for the recovery of mineral values from base metal and precious metal ores is disclosed. Specifically, a froth flotation process is disclosed which comprises contacting an aqueous ore slurry with an effective amount of a dihydroxyalkyl group containing polysaccharide, a mineral collector and a frothing agent.

16 Claims, No Drawings

METHOD FOR THE DEPRESSING OF HYDROUS SILICATES AND IRON SULFIDES WITH DIHYDROXYALKYL POLYSACCHARIDES

BACKGROUND OF THE INVENTION

The present invention relates to a froth flotation process for the recovery of mineral values from base metal and precious metal ores. More particularly, it relates to a new and improved process for beneficiating minerals by froth flotation incorporating a new class of depressants.

Certain theory and practice state that the success of a flotation process depends to a great degree on reagents called collectors that impart selective hydrophobicity to the mineral value which has to be separated from other minerals.

Certain other important reagents, such as the modifiers, are also largely responsible for the success of flotation separation of minerals. Modifiers include all reagents whose principal function is neither collecting nor frothing, but one of modifying the surface of the mineral so that the collector either adsorbs to it or does not. Modifying agents may thus be considered as depressants, activators, pH regulators, dispersants, deactivators, etc. Often, a modifier may perform several functions simultaneously.

In addition to attempts at making the collectors more selective for value minerals, other approaches to the problem of improving the flotation separation of value minerals have included the use of modifiers, more particularly depressants, to depress hydrous, layered silicates such as talc and other gangue minerals so that they do not float in the presence of collectors, thereby reducing the levels of non-value contaminants reporting to the concentrates. As has been mentioned above, a depressant is a modifier reagent which selectively adsorbs onto certain unwanted minerals thus making them hydrophilic and unable to float. Depressants can also prevent or inhibit adsorption of the collectors onto certain of the mineral particles surfaces present in the flotation slurry or pulp.

Hydrated silicates such as talc, i.e., magnesium silicate, which, because of their crystalographic structure, behave as a hydrophobic mineral when ground and slurried with water. The silicates therefore cause problems when associated with ores or minerals that contain value metals such as gold, platinum, nickel, zinc, lead and copper which are to be recovered by froth flotation. In the flotation of such hydrous, layered silicates as talc and pyrophyllite, depressants such as guar gum, starch, dextrin and carboxymethylcellulose have been found to be useful commercially. Guar gum and carboxymethylcellulose are the only two widely employed, with the guar gum the most common depressant for talc by far. These conventional depressants, however, represent a number of serious problems and have serious shortcomings attendant with their use. Guar gum, for example, is difficult to dissolve. Moreover, the conventional depressants are either non-selective or, when used in sufficient quantities to provide good separation, provide economically unsatisfactory concentrates, i.e., the yield of value minerals is too low.

The benefication criteria for treating complex ores are maximum recovery of value metal and precious metals (if any are present) and minimum contamination of the value concentrate by non-value hydrous, layered silicates such as talc. In many cases, these criteria cannot be met without seriously sacrificing value metals production or recovery. Therefore, there remains an urgent need for flotation reagents that can selectively depress talc reporting to the concentrate and concurrently provide economically acceptable recoveries of value minerals.

K. F. Lin etal; Surfactant Sci. Ser.; 1988; Polymeric Depressants; 27 (Reagents Miner, Technol.) pgs. 471–483 (Eng.); Hercules, Inc. Wilmington, Del. teach the use of polysaccharides as depressants and show specifically dihydroxpropylcellulose as a depressant for clay slime in a potash ore. The depressant was found to be intermediate to guar and starch for depressing clay. The process of the instant invention, however, relates to the beneficiation of value minerals from hydrophobic sulfide ores. Whereas potash ores are treated with long chain oxhydryl or cationic collectors which function by physical adsorption onto the potash (KCl) and float it, and the depressant stops the collector from adsorbing on the clay slimes present, such as kaolinite, sulfide ores are treated with sulfhydryl anionic collectors which function by chemical adsorption onto the sulfide mineral and float it and the depressant stops the collector from adsorbing onto the hydrous silicate (talc) and ferrous sulfide present. Thus, the use of 2,3-dihydroxypropylcellulose as a depressant in potash ore flotation would not suggest to one skilled in the art to utilize the instant depressants in sulfide ore flotation because of the dissimilarities of the two systems regarding collector functionality.

Unexpectedly, in view of the foregoing, it has now been discovered that dihydroxyalkyl polysaccharides are very selective depressants for hydrous, layered silicates. The use of the dihydroxyalkyl saccharides of the present invention provide a substantial reduction in talc contamination in the mineral concentrates reporting to the smelters and are more readily dissolved in water, i.e they have a more rapid hydration time than guar gum, and also provide maximum recovery of values from ores.

DESCRIPTION OF THE INVENTION

The present invention provides a new and improved method for the beneficiation of value minerals or metals from sulfide ores with selective rejection of hydrous, layered silicates and/or iron sulfides, said method comprising:

a) providing an aqueous pulp slurry of finely divided, liberated ore particles;

b) conditioning said pulp slurry with an effective amount of a beta-1→4 polysaccharide containing pendant, viscinal dihydroxyalkyl group containing ether, polyether, ester or etherester substituents, to selectively depress the hydrous, layered silicates and/or iron sulfides, a mineral collector and a frothing agent;

c) subjecting the conditioned pulp slurry to froth flotation to produce a froth containing beneficiated value minerals and a resultant pulp slurry containing said depressed, layered silicates and/or iron sulfides and d) recovering the beneficiated value minerals from the froth.

The new and improved method for beneficiating value minerals by froth flotation procedures employing the dihydroxyalkyl polysaccharides in accordance with this invention can provide excellent metallurgical recovery with significant improvements in grade. The dihydroxyalkyl polysaccharides are effective over a reasonably wide range of pH and dosages are compatible with available frothers and mineral collectors and may be readily incorporated into any currently operating system or facility.

The beta-1→4 polysaccharides containing pendant, viscinal, dihydroxyalkyl ether, polyether, ester or etherester substituents are known in the art. The 2,3-dihydroxypropyl ether of cellulose, the preferred depressant of this invention, for example, has been known for many years, see U.S. Pat. No. 2,135,128 (1938). They may be prepared by the reaction of the polysaccharide, e.g. cellulose, carboxymethylcellulose (or other cellulose derivatives), alginic acid, mannan and the like, in a suitable solvent such as acetone, containing sodium hydroxide, with 2,3-epoxy-1-propanol, glycidol, i.e. 2,3-dihydroxy-1-propanol, such as is described in U.S. Pat. No. 4,001,210, which patent is hereby incorporated herein by reference. 2,3-dihydroxylpropane halides, e.g. 2,3-dihydroxy-3-chloropropane, and other reactive, alphatic, halide derivatives with viscinal hydroxy groups, i.e. 4-chlorobutanetriol-1,2,3; 6-bromohexanediol-1,2 and the like, may also be used in forming the derivatives used herein. Where on the polysaccharide ring the dihydroxyalkyl substituent is positioned is not known; however, as used herein, the term "a dihydroxyalkyl derivative" is meant to include any ether, polyether, ester or etherester situated at any position. Further, mixed ethers, polyethers, esters and etheresters may be used, i.e. those derived from a polysaccharide already containing an ether, ester, etc. substituent. Also, more than one mole of, for example, glycidol per mole of polysaccharide may be used in preparing the depressant, thereby forming more than one dihydroxyalkyl substituent on the polysaccharide. All such products are useful in the process of the present invention. This process was used to produce the derivatives used herein except that hydrochloric acid only was used for the neutralization of the sodium hydroxide. The same procedure was used to prepare 2,3-dihydroxypropylamylose and 2,3-dihydroxypropylstarch for comparative purposes except that amylose or starch are substituted for the polysaccharide.

The dihydroxyalkyl polysaccharides useful herein generally have a molecular weight ranging from about 20,000 to about 1,000,000, preferably from about 50,000 to about 600,000, and a molar substitution (MS) ranging from about 1 to about 12, preferably from about 1.5 to about 6.0.

The present invention is specifically directed to the depression of hydrous, layered silicates such as talc during the froth flotation of such materials as copper ores, copper-molybdenum ores, complex ores containing lead, copper, zinc, silver, gold, etc., nickel and nickel-cobalt ores, gold ores and gold-silver ores etc. to facilitate copper-lead, lead-zinc, copper-zinc separations, etc.

DESCRIPTION OF THE PREFERRED EMBODIENTS

The following examples are set forth for purposes of illustration only and are not to be construed as limitations on the present invention, except as set forth in the appended claims. All parts and percentages are by weight unless otherwise specified. In the examples, the guar gum used is a commercial guar gum depressant having a molecular weight of about 350K.

Cellulose of various sources was used, such as that derived from wood pulp and cotton linters, having different reactivities and molecular weights. For amylose, the closest analogue to cellulose except for the configuration of their glycosidic linkages, a potato starch amylose was used. Cornstarch served as a representative for starch.

The samples are characterized in terms of total molar substitution (MS)* via $^{13}C$-NMR analysis by comparison of the integral of the anomeric carbons of the sugar units of the polysaccharide with the integral of all other carbons; (Varian VXR-400); *(see R. L. Davidson, Handbook of Water-Soluble Gums and Resins; McGraw-Hill; N.Y., 1980, 3-2).

Molecular weights were determined by supplier's specification or by high performance size exclusion chromatography (HPSEC), relative to Pullulan standards. (Pullulan standards $M_2$=5800-853000; Polymer Laboratories Ltd. Stow, Ohio). A set of Toyo Soda (Japan) columns was used with a $NaCl/NaH_2PO_4$ solution (pH=7) as mobile phase, Detector: Differential Refractometer, Waters Model 41D.

EXAMPLE 1

1000 parts of crushed ore containing lead sulfides and lesser amounts of zinc sulfides are ground in a rod mill with 350 parts of tap water for 15 minutes. To the slurry are added 90 g/t of sodium ethyl xanthate and 90 g/t of sodium cyanide and grinding continued for another 10 minutes to achieve a grind of 66% passing 74 microns. The ground slurry is transferred to a three liter stainless steel D-12 Denver flotation cell to which are added 40 g/t of methyl isobutyl carbinol as a frother and 30 g/t of the depressant. The water level is made up with tap water. The mixture at natural pH is stirred at 1,500 rpm with an air flow of 6.1 l/min. and the first concentrate is collected for 90 seconds. An additional 30 g/t of methyl isobutyl carbinol are added. The air is switched on, and a second concentrate is collected for 150 seconds. 20 g/t of methyl isobutyl carbinol are added with the air switched off, agitation is continued for 80 seconds, the air is switched on again and a third concentrate is collected with stirring for 480 seconds. Concentrates and tails are filtered, dried, combined and assayed for lead, zinc and iron.

The recovery and grade are calculated from the weights and assays. The results are set forth in Table I, below.

TABLE I

| Depressant | Cum. Mass % | Cum. Pb | Recovery Zn | % Fe | Cum. Pb | Grade Zn | %* Fe |
|---|---|---|---|---|---|---|---|
| CT-Guar Gum 30 g/t | 13.3 | 68.8 | 17.3 | 14.0 | 53.2 | 12.0 | 11.8 |
| CT-Guar Gum 30 g/t | 12.8 | 68.8 | 17.7 | 13.2 | 51.5 | 12.7 | 12.1 |
| 2,3-dihydroxy-propyl-cellulose | 11.4 | 68.8 | 15.1 | 10.9 | 59.0 | 11.7 | 8.7 |

TABLE I-continued

| Depressant | Cum. Mass % | Cum. Pb | Recovery Zn | % Fe | Cum. Pb | Grade Zn | %* Fe |
|---|---|---|---|---|---|---|---|
| m.w. 85K MS 1.5 30 g/t | | | | | | | |

CT = Comparative Test
* = 1st Concentrate
Cum. = cumulative

Use of 2,3-dihydroxypropylcellulose yields a higher grade of lead in the concentrate by depression of iron sulfide than the commonly used guar gum depressant. Since refining plants have lower limits on the acceptable percent of lead in the concentrate for refining the lead concentration is critical in a commercial operation.

EXAMPLE 2

1,000 parts charge of crushed ore containing nickel and copper sulfide minerals, platinum group metals and gold as well as 10–15% readily floatable talc gangue are ground in a rod mill with 700 ml. of tap water, 40 ml. of 0.5% ammonia solution, 5.0 ml. of 1.0% potassium n-butyl xanthate and 4.0 ml. of 1.0 copper II sulfate for 19.5 minutes. The contents, which are ground to 73% of 75 microns size, are washed into a three liter stainless steel D-12 Denver Flotation machine cell and agitated at 1,500 rpm for one minute. The pH is normally 9.2 to 9.6. To the mixture are added 2.0 ml. of 1% potassium n-butyl xanthate. The mixture are conditioned for one minute, then 30 microliters of triethoxybutane are added and conditioned for 30 seconds. Then ¾ of the total depressant dose of 325 g/t is added and conditioned for 30 seconds. An air flow of 8.0 liters per minute is run for 4.0 minutes and the first concentrate froth is scraped at intervals. A second concentrate is obtained by adding 1.0 ml. of 1.0% potassium n-butyl xanthate and conditioning for 1.0 minute, then 1.0 ml. of copper II sulfate with conditioning for 30 seconds and then the remaining depressant with conditioning for 30 seconds. The air flow is restarted for 4.0 minutes and the second concentrate is collected. A third concentrate is obtained by adding 1.0 ml. of potassium n-butyl xanthate with conditioning for 1.0 minute, then 1.0 ml. of 1.0% copper II sulfate with conditioning for 1.0 minute with the air off. The air flow is restarted for 4.0 minutes and the third concentrate is collected. The concentrates are filtered, dried and the samples and subsamples are analyzed.

The results are set forth in Table IIA and Table IIB.

TABLE II-A

| Depressant | Weight % | | | Cum. Nickel Recovery | | | Cum. Nickel Grade | | | Calculated |
|---|---|---|---|---|---|---|---|---|---|---|
| 325 g/t | C-1 | C-2 | C-3 | C-1 | C-2 | C-3 | C-1 | C-2 | C-3 | % Ni in head |
| Set I | | | | | | | | | | |
| CT-Guar Gum | 6.77 | 2.62 | 2.77 | 49.2 | 57.7 | 61.8 | 5.06 | 4.28 | 3.53 | 0.70 |
| 2,3-Dihydroxypropylcellulose m.w. 580K MS 6.0 | 2.70 | 0.72 | 0.95 | 31.9 | 36.8 | 46.1 | 8.69 | 7.90 | 7.74 | 0.74 |
| 2,3-Dihydroxypropylamylose m.w: 111K MS 2.7 | 7.05 | 1.73 | 1.94 | 31.2 | 36.8 | 46.5 | 3.13 | 2.97 | 3.07 | 0.71 |
| 2,3-Dihydroxypropylstarch m.w. 1M MS 1.8 | 4.48 | 1.15 | 1.96 | 25.8 | 30.1 | 41.8 | 3.99 | 3.70 | 3.81 | 0.69 |
| Set 2 | | | | | | | | | | |
| CT-Guar Gum | 5.41 | 1.96 | 2.27 | 45.8 | 54.9 | 59.5 | 5.83 | 5.13 | 4.25 | 0.69 |
| 2,3-Dihydroxypropylcellulose m.w. 115K MS 5.8 | 2.26 | 1.07 | 0.96 | 28.6 | 34.5 | 43.5 | 8.95 | 7.34 | 7.18 | 0.17 |
| CT-Hydroxyethylcellulose m.w. 90–105K | 20.3 | 7.14 | 1.11 | 47.8 | 55.1 | 60.5 | 1.52 | 1.30 | 1.37 | 0.65 |
| CT-Methylcellulose-m.w. 115K | 25.1 | 5.36 | 2.19 | 55.8 | 60.8 | 65.2 | 1.44 | 1.29 | 1.29 | 0.65 |
| CT-Carboxymethlycellulose* m.w. 450K | 22.0 | 2.79 | 1.36 | 49.5 | 59.3 | 63.1 | 1.54 | 1.64 | 1.65 | 0.68 |
| Set 3 | | | | | | | | | | |
| CT-Guar Gum | 10.6 | 2.83 | 2.78 | 52.6 | 60.0 | 63.9 | 3.34 | 3.01 | 2.66 | 0.67 |

TABLE II-A-continued

| Depressant 325 g/t | Weight % C-1 | Weight % C-2 | Weight % C-3 | Cum. Nickel Recovery C-1 | Cum. Nickel Recovery C-2 | Cum. Nickel Recovery C-3 | Cum. Nickel Grade C-1 | Cum. Nickel Grade C-2 | Cum. Nickel Grade C-3 | Calculated % Ni in head |
|---|---|---|---|---|---|---|---|---|---|---|
| CT-Hydroxy-propyl-cellulose m.w. 300K | 32.8 | 7.33 | — | 59.9 | 67.7 | — | 1.18 | 1.09 | — | 0.65 |
| 2,3-Di-hydroxy-propyl-cellulose m.w. 115K | 3.36 | 0.88 | 0.85 | 33.2 | 37.4 | 44.7 | 6.61 | 5.90 | 5.87 | 0.67 |

CT = Comparative Test
C-1 = Concentrate Number
* = determined by HPSEC

As shown in Table IIA set I, 2,3-dihydroxypropylcellulose produces concentrates of vastly superior grade to the 2,3-dihydroxypropyl derivatives of amylose and starch without loss in recovery on the nickel/copper ore charged.

2,3-dihydroxypropylcellulose is also shown to be a superior depressant for talc when compared to the following commercial samples of more or less strongly related, water-soluble cellulose derivatives: hydroxyethylcellulose (HEC), methylcellulose (MC), carboxymethylcellulose (CMC) and hydroxypropylcellulose (HPC) (see Sets 2 and 3 of Table II-A).

These various cellulose ethers are reported to have molar substitution of 0.4–4.5, specifically HEC: 1.8–3.5; MC: 0.4–1.2; CMC: 0.4–1.2 and HPC: 3.5–4.5. See M. D. Nicholson et al; Cellulose Chemistry and its Applications; ed. T. P. Nevell and S. H. Zeronian; John Wiley and Sons; N.Y.; 1985; pgs 363–383. They fall in the range of the molar substitution of the 2,3- dihydroxypropylecelluloses shown herein.

The platinum group metals plus gold are also recovered in the flotation froth as is shown in Table II-B. 2,3-dihydroxypropylcellulose yields a better grade and superior recoveries of the platinum group metals and gold than does carboxymethylcellulose.

TABLE II-B

| Depressant | Dosage g/t | Weight % Cumulative C-1 | Weight % Cumulative C-2 | Weight % Cumulative C-Total | Cumulative Platinum Group & Gold Recovery % C-1 | Cumulative Platinum Group & Gold Recovery % C-2 | Cumulative Platinum Group & Gold Recovery % C-Total | Cumulative Platinum Group & Gold Grade % C-1 | Cumulative Platinum Group & Gold Grade % C-2 | Cumulative Platinum Group & Gold Grade % C-Total |
|---|---|---|---|---|---|---|---|---|---|---|
| CT-Carboxy-methyl-cellulose* | 300 | 1.68 | 3.68 | 5.12 | 50.3 | 60.5 | 63.1 | 152 | 83.8 | 62.8 |
| CT-Carboxy-methyl-cellulose* | 150 | 1.99 | 4.04 | 5.46 | 50.0 | 61.0 | 64.6 | 128 | 76.9 | 60.3 |
| CT-Carboxy-methyl-cellulose* | 300 | 1.22 | 3.20 | 4.59 | 45.7 | 60.1 | 63.4 | 192 | 95.8 | 70.5 |
| 2,3-Dihydroxy-propyl-cellulose** | 50 | 1.51 | 3.58 | 4.93 | 42.1 | 58.0 | 62.9 | 142 | 82.5 | 65.1 |
| 2,3-Dihydroxy-propyl-cellulose** | 100 | 1.27 | 2.95 | 4.27 | 45.2 | 57.8 | 62.0 | 181 | 100.0 | 74.0 |
| 2,3-Dihydroxy-propyl-cellulose** | 150 | 1.55 | 2.89 | 3.81 | 52.8 | 64.2 | 68.0 | 173 | 113.0 | 91.0 |
| 2,3-Dihydroxy-propyl-cellulose** | 200 | 0.98 | 1.95 | 2.63 | 50.1 | 62.5 | 66.3 | 260 | 163.0 | 129.0 |
| 2,3-Dihydroxy-propyl-cellulose** | 250 | 1.07 | 1.85 | 2.42 | 54.0 | 66.7 | 70.4 | 256 | 184.0 | 149.0 |

CT = Comparative Test
* = m.w. 450K
** = 115K; MS 5.8
C-1 = Concentrate

EXAMPLE 3

1,000 parts charge of a nickel sulfide containing ore are crushed and processed as stated in Example 2 and the results are set forth in Table III.

TABLE III

| Depressant | Weight % C-1 | Weight % C-2 | Weight % C-3 | Cum. Nickel Recovery C-1 | Cum. Nickel Recovery C-2 | Cum. Nickel Recovery C-3 | Cum. Nickel Grade C-1 | Cum. Nickel Grade C-2 | Cum. Nickel Grade C-3 | Calculated % Ni in head |
|---|---|---|---|---|---|---|---|---|---|---|
| CT-Guar Gum 325 g/t | 14.3 | 3.36 | 2.24 | 64.1 | 46.1 | 39.5 | 3.45 | 10.6 | 13.6 | 0.77 |
| 2,3-Di-hydroxy-propyl-cellulose | 7.3 | 2.33 | 1.70 | 55.8 | 44.6 | 41.3 | 5.73 | 14.3 | 18.3 | 0.75 |

TABLE III-continued

| Depressant | Weight % | | | Cum. Nickel Recovery | | | Cum. Nickel Grade | | | Calculated |
|---|---|---|---|---|---|---|---|---|---|---|
| | C-1 | C-2 | C-3 | C-1 | C-2 | C-3 | C-1 | C-2 | C-3 | % Ni in head |
| 250 g/t | | | | | | | | | | |

CT = Comparative Test
C-1 = Concentrate Number
* = m.w. 580K; MS 6.0

An illustration of the advantages of 2,3-dihydroxypropylcellulose as a gangue depressant in the cleaning stages of froth flotation is that the combined three flotation concentrates from Table III are taken further with two addition flotation stages. The object of the test is to determine which reagent allows the greatest recovery of nickel at the grade of 11% nickel, since this is the grade of the final concentrate produced at the mine.

The three rougher concentrates of Example 3 are combined in a one liter Denver cell. Tap water is added to the standard level and the mixture is stirred at the reduced impellar speed of 1,000 rpm.

The mixture is conditioned for 30 seconds, 1.0 ml. of potassium n-butyl xanthate is added with conditioning for 1.0 minute, 6.0 microliters of triethoxybutane frother are added and conditioned for 30 seconds. 65 g/t of depressant are then added with conditioning for 30 seconds. Air is passed through the mixture at a rate of 4 liters/minute for 6 minutes. The mixture is scraped to produce a concentrate which is combined with tailings, and filtered to make the first cleaner concentrate.

The first cleaner concentrate is returned to the one liter Denver cell, tap water is added to the standard level, the mixture is stirred at 1,000 rpm for 30 seconds, 0.5 ml of potassium n-butyl xanthate is added with stirring for 1.0 minute, 6.0 microliters of triethyoxybutane frother are added with stirring for 30 seconds and 32 g/t of depressant are added. Air is passed into the mixture at a rate of 4 liters/minute for 4 minutes, and the froth is scraped to produce a concentrate which is combined with tailings, filtered and dried.

The recoveries of nickel from the second concentrate are 45.0% when guar gum is the depressant and 48.4% when 2,3-dihydroxypropylcellulose is the depressant. Thus, 2,3-dihydroxypropylcellulose allows a 3.4% greater recovery of nickel at a grade of 11%. Although overall recoveries at 11% nickel grade appear low, of the nickel contained in the ore, only 80% occurs as sulfide. The remainiing is refractory nickel which is not recovered by flotation. Also laboratory scale recoveries tend to be less than those obtained on a plant scale.

It is noted that 2,3-dihydroxypropylcellulose produced the 11% grade nickel at lower doses with only a single cleaning stage. On a plant scale, fewer cleaning stages are required and result in a reduction of equipment and operating cost.

EXAMPLE 4

The following example demonstrates that 2,3-dihydroxypropylcellulose can act as a selective sulfide depressant.

1,000 parts charge of crushed ore containing nickel sulfide minerals (mainly as pentlandite) and iron sulfide mineral (pyrrhotite) are ground and conditioned as in Example 2.

The results are set forth in Table IV.

TABLE IV

| Depressant at 325 g/t | Concentrate | Weight % | Ni % | Cumulative % Ni Recovery |
|---|---|---|---|---|
| CT-Guar Gum | C-1 | 5.41 | 5.83 | 45.8 |
| | C-2 | 1.96 | 3.20 | 54.9 |
| | C-3 | 2.27 | 1.39 | 59.5 |
| | Tails | 90.4 | 0.31 | — |
| 2,3-Dihydroxy-propyl-cellulose MW-115K | C-1 | 2.26 | 8.95 | 28.3 |
| | C-2 | 1.07 | 3.94 | 34.2 |
| | C-3 | 0.96 | 6.61 | 43.1 |
| | Tails | 95.7 | 0.42 | — |

CT = Comparative Test
C-1 = Concentrate Number

The three concentrates and tails of each of the two flotations are subjected to an X-ray diffraction trace over the 2.07 Angstrom pyrrhotite peak. The results indicate that the three guar gum concentrates have a much greater pyrrhotite content than the three 2,3-dihydroxypropylcellulose concentrates. In addition, the mass of each of the three guar gum concentrates as shown in Table IV, are about twice the mass as the corresponding 2,3-dihydroxypropylcellulose concentrates. Thus, the guar gum sample contains about twice the mass of pyrrhotite.

2,3-dihydroxypropylcellulose depresses pyrrhotite to a greater extent than the nickel containing sulfides. With this particular ore this is not an advantage since the pyrrhotite contains small quantities of nickel, as nickeliferous pyrrhotite, which is depressed with 2,3-dihydroxypropylcellulose and accounts for the lower nickel recoveries. There are sulfide ores where the pyrrhotite contains no values and for these ores dihydroxypropylcellulose would be a valuable depressant.

EXAMPLE 5

2,3-Dihydroxypropylcellulose is compared with carboxymethylcellulose as a talc depressant in a platinum group metal float. The test procedure is as follows:

1,000 parts of ore are ground with 350 ml. of tap water in a rod mill for 60 minutes to produce a flotation feed of 66%–74 microns which contains 75% solids. The slurry is transferred to a D-12 Denver flotation machine with a 3 liter cell and water is added to reduce the mixture to a 31% solids. This pulp is conditioned at 1,000 rpm at a natural pH of 9.1. To the slurry are added 40 g/t of copper II sulfate with stirring for 7 minutes, 180 g/t of sodium n-propyl xanthate with stirring for 5 minutes, 20 g/t of polyethyleneglycol of 250,000 mol. wt. with stirring for another minute and depressant is added with stirring for one minute. Air is forced through the slurry at a rate of 8.0 liters per minute for 2.0 minutes, the air is turned off and the first concentrate is collected. The air is turned on again for another 7.0 minutes and a second concentrate is collected. The results are as shown in Table V.

TABLE V

| Depressant | Concentration g/t | Cumulative Pt Group Metal % Recovered | Cumulative Pt Group Metals % Grade |
|---|---|---|---|
| CT-Carboxy-methyl-cellulose | 150 | 60.3 | 64.6 |
| CT-Carboxy-methyl-cellulose | 300 | 62.8 | 63.1 |
| CT-Carboxy-methyl-cellulose | 300 | 70.5 | 63.4 |
| 2,3-Dihydroxy-propyl-cellulose* | 50 | 65.1 | 62.9 |
| 2,3-Dihydroxy-propyl-cellulose* | 100 | 74.0 | 62.0 |
| 2,3-Dihydroxy-propyl-cellulose* | 150 | 91.0 | 68.0 |
| 2,3-Dihydroxy-propyl-cellulose* | 200 | 129.0 | 66.3 |
| 2,3-Dihydroxy-propyl-cellulose* | 200 | 149.0 | 70.4 |

CT = Comparative Test
* m.w. = 115K; MS 5.8

At an equivalent dosage level 2,3-dihydroxpropylcellulose achieves both higher platinum group metals recoveries and grades as compared to carboxymethylcellulose. Since the plant target grade is 200–220 g/t, substantially less concentrate cleaning should result in higher overall platinum group recoveries when 2,3-dihydroxypropylcellulose replaces carboxymethylcellulose.

EXAMPLE 6

The procedure of Example 2 is again followed except that the Denver flotation machine cell is agitated at 1250 r.p.m. and a different 2,3-dihydroxypropyl polysaccharide is substituted for the cellulose derivative thereof. The results are set forth in Table VI, below.

TABLE VI

| Depressant | Concentration g/t | Cumulative Ni % Recovered | Cumulative Ni % % Grade |
|---|---|---|---|
| CT-Guar Gum | 325 | C-1 43.0 | C-1 5.45 |
| | | C-2 56.0 | C-2 4.65 |
| | | C-3 63.0 | C-3 3.80 |
| 2,3-Dihydroxy-propylmannan | 325 | C-1 39.5 | C-1 7.05 |
| | | C-2 51.0 | C-2 6.20 |
| | | C-3 56.5 | C-3 5.00 |
| 2,3-Dihydroxy-propylcellulose | 325 | C-1 31.5 | C-1 8.75 |
| | | C-2 41.0 | C-2 7.75 |
| | | C-3 51.0 | C-3 7.30 |

EXAMPLE 7

Again following the procedure of Example 2 except that 2,3-dihydroxypropylmethylcellulose is employed at 325 g/t; the results are achieved as set forth in Table VII, below.

TABLE VII

| Cumulative Ni % Recovered | Cumulative Ni % % Grade |
|---|---|
| C-1 59.0 | C-1 1.2 |

TABLE VII-continued

| Cumulative Ni % Recovered | Cumulative Ni % % Grade |
|---|---|
| C-2 68.2 | C-2 1.0 |

These results are considerably poorer compared to guar gum and 2,3-dihydroxypropylcellulose derivatives; however, they indicate that nickel recovery is achieved.

EXAMPLE 8

Using the procedure of Example 2 except that 2,3-dihydroxypropylhydroxyethylcellulose (HHC) is employed, talc is depressed; however, nickel recovery is poor. The high molecular weight (2.5 million) of this reagent is reduced by ultrasonic degradation as indicated by viscosity reduction. The reduction of the molecular weight to 570K provides better nickel grades and improved recovery, as indicated below. Guar gum, at 325 g/t results in the following values: Cum. Conc. Grade (Ni%) C-1 5.3; C-2 4.8; C-3 3.9. Cum. Recovery (%) C-1 43.0; C-2 52.0; C-3 55.5. HHC, at 200 g/t results in the following values: (2 samples) Cum. Conc. Grade (Ni%) C-1 5.7; 6.3; C-2 4.8; 5.4; C-3 4.25; 4.95. Cum. Recovery(%) C-1 38.0; 38.5; C-2 42.5; 44.0; C-3 47.0; 49.5, respectively.

EXAMPLE 9

The procedure of Example 6 is again followed except that a 2,3-dihydroxypropyl derivative of alginic acid is employed as the depressant. Similar results are achieved.

EXAMPLE 10

Following the procedure of Example 9 is followed except that a hydroxypropyl, 2,3-dihydroxypropyl derivative of alginic acid employed as the depressant; efficient nickel recovery is effected.

We claim:

1. A method for the beneficiation of value minerals from sulfide ore containing said value minerals and hydrous, layered silicates and/or iron sulfides with selective rejection of said hydrous, layered silicates and/or iron sulfides which comprises:

a) providing an aqueous pulp slurry of finely-divided, liberated particles of said ore;

b) conditioning said pulp slurry with an effective amount of a beta-1→4 polysaccharide containing a pendant, viscinal dihydroxyalkyl 1) ether, 2) polyether, 3) ester or 4) etherester substituent to selectively depress said hydrous, layered silicates, and/or iron sulfides, a value mineral collector and a frothing agent, respectively;

c) subjecting the conditioned pulp slurry to froth flotation to produce a froth containing beneficiated value minerals and a resultant pulp slurry containing said depressed, layered silicates and/or iron sulfides and d) recovering the beneficiated value minerals from the froth.

2. A method according to claim 1 wherein the collector is a xanthate.

3. A method according to claim 1 wherein the beta-1→4 polysaccharide is a 2,3-dihydroxypropyl ether.

4. A method according to claim 1 wherein the ore is a nickel ore.

5. A method according to claim 1 wherein the ore is a platinum group metal ore.

6. A method according to claim 1 wherein the ore is a gold ore.

7. A method according to claim 1 wherein the ore is a copper ore.

8. A method according to claim 1 wherein the ore is a zinc ore.

9. A method according to claim 1 wherein the ore is a lead ore.

10. A method according to claim 1 wherein the ore contains hydrous, layered silicates.

11. A method according to claim 1 wherein the ore contains iron sulfides.

12. A method according to claim 3 wherein the 2,3-dihydroxy-propyl ether beta 1→4 polysaccharide has a molecular weight ranging from about 20,000 to about 1,000,000.

13. A method according to claim 3 wherein the 2,3-dihydroxypropyl ether beta 1→4 polysaccharide has a molar substitution ranging from about 1 to about 12.

14. A method according to claim 12 wherein the molecular weight ranges from about 50,000 to about 600,000.

15. A method according to claim 13 wherein the molar substitution ranges from about 1.5 to 6.0.

16. A method according to claim 3 wherein the polysaccharide is cellulose.

* * * * *